United States Patent [19]

Müller et al.

[11] Patent Number: 4,475,822

[45] Date of Patent: Oct. 9, 1984

[54] ELECTRONIC WATCH WITH CONDUCTOR TRACKS FORMED ON THE WATCH GLASS

[75] Inventors: Jacques Müller, Reconvilier; Elmar Mock, Bienne, both of Switzerland

[73] Assignee: ETA, S.A., Fabriques d'Ebauches, Switzerland

[21] Appl. No.: 265,608

[22] Filed: May 20, 1981

[30] Foreign Application Priority Data

May 28, 1980 [CH] Switzerland ..... 4129/80

[51] Int. Cl.[3] ..... G04C 23/02

[52] U.S. Cl. ..... 368/88; 368/296

[58] Field of Search ..... 368/88, 233, 255, 223, 368/250, 294, 327, 281, 296, 224, 69

[56] References Cited

U.S. PATENT DOCUMENTS 4,059,956 11/1977 Maeda et al. ..... 368/224
4,196,577 4/1980 Ohno et al. ..... 368/88
4,228,534 10/1980 Fellrath et al. ..... 368/239
4,237,548 12/1980 Fellrath et al. ..... 368/224
4,257,117 3/1981 Besson ..... 368/69
4,362,397 12/1982 Klingenberg ..... 368/233

FOREIGN PATENT DOCUMENTS 2062911 5/1981 United Kingdom ..... 368/255

*Primary Examiner*—Bernard Roskoski
*Attorney, Agent, or Firm*—Allegretti, Newitt, Witcoff & McAndrews Ltd.

[57] ABSTRACT

An electronic watch in which the inside face of the glass 6 of the watch comprises, on its periphery, conductor deposits (10, 16, 22, 32) forming the conductor tracks of a printed circuit, the insulating substrate of which is formed by capacitor 14, the resonator 20 or the integrated circuit 18 are fixed directly on the glass. Electrical contact means (12, 28, 30, 46) form the connections between the conductor tracks and other components which are housed in the watch casing. A deposit (8) forming a masking means on the outside face of the glass hides the printed circuit and the components.

7 Claims, 5 Drawing Figures

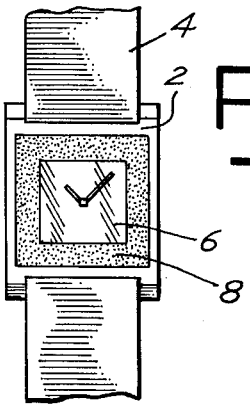
Fig. 1
Fig. 2
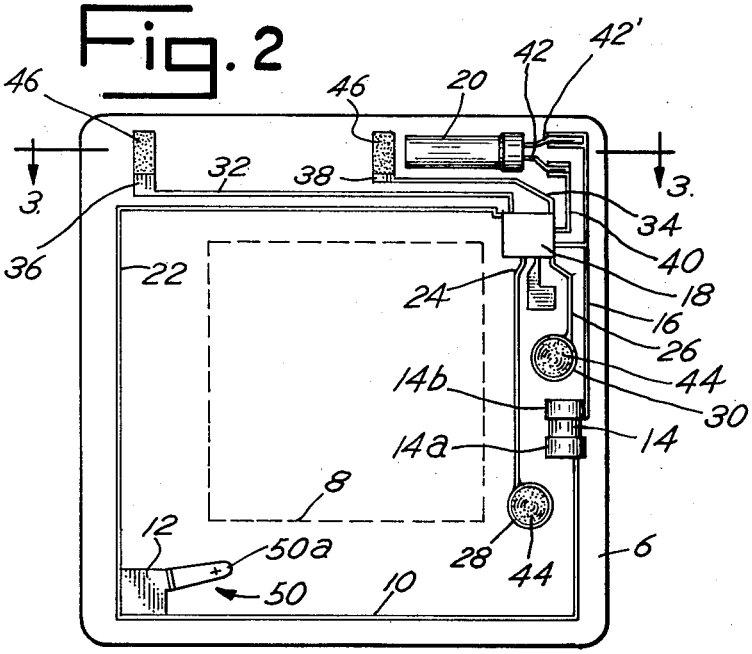
Fig. 3
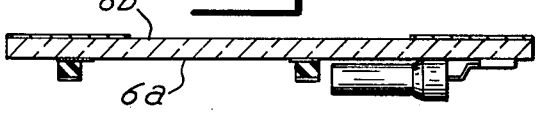
Fig. 4
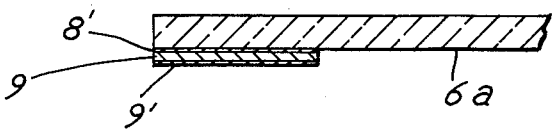

ELECTRONIC WATCH WITH CONDUCTOR TRACKS FORMED ON THE WATCH GLASS

BACKGROUND OF THE INVENTION

The present invention relates to electronic watches comprising, within a casing provided with a glass, as is well known, a battery, an analog or digital display system, a resonator, an integrated circuit and a printed circuit for making connections between those various components.

In the prior art relating to electronic watches, the printed circuit comprises a rigid or flexible insulating carrier on which conductor tracks are deposited. The conductor tracks are connected to the various electrical or electronic components of the watch. The printed circuit is generally fixed on the plate of the watch by means of its insulating carrier. Consequently, it is necessary in fact to use an independent printed circuit, the cost of which may be relatively high. Futhermore, the printed circuit occupies a certain space on the plate or one of the bridge members of the watch, thereby reducing the space available for housing, for example, the bearings of the movement members or other components of the watch.

BRIEF SUMMARY OF THE INVENTION

In order to overcome these disadvantages, the present invention concerns an analog or digital electronic watch in which the conductor tracks connecting the different components of the watch are formed on the inside face of the glass of the watch, the glass thus serving as an insulating carrier. In addition, some of the components may be directly fixed on the inside face of the glass.

BRIEF DESCRIPTION OF THE DRAWINGS

The invention will be better appreciated from the following detailed description of a number of illustrative embodiments of the invention which are given by way of non-limiting examples. The description is given with reference to the accompanying drawings in which:

FIG. 1 shows a general view of the watch comprising a glass, according to the invention;

FIG. 2 shows a view from below of the glass showing its inside face provided with the printed circuit;

FIG. 3 shows a view in vertical section taken along line III—III in FIG. 2;

FIG. 4 shows a view in vertical section of part of an alternative embodiment of the glass in which the masking means is disposed on the inside face of the glass.

DETAILED DESCRIPTION OF THE PREFERRED EMBODIMENTS

Figure 5:
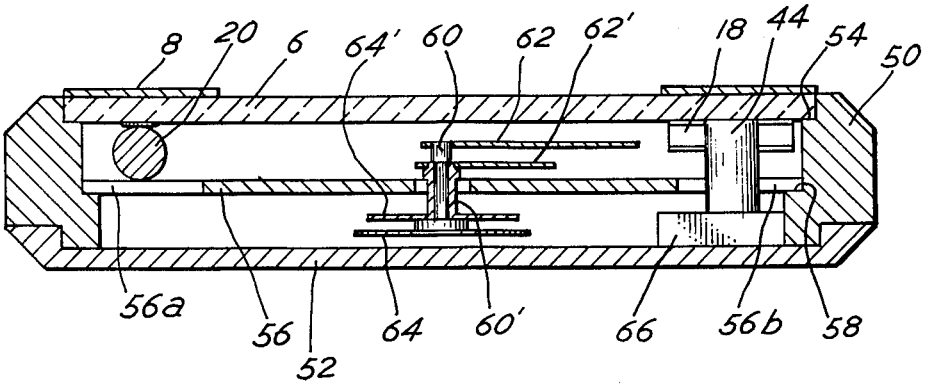
FIG. 5 shows a view in vertical section of a watch according to the invention.

FIG. 1 shows a general outside view of a watch provided with a glass in accordance with the invention. In known manner, the watch comprises a casing 2 and a strap 4. A glass 6 is mounted on the casing 2 by any suitable means. As can be seen from FIG. 1, the glass is provided on its edge with a uniform masking means 8, the function of which, as already explained, is to mask the printed circuit which is deposited on the glass itself and which will be described hereinafter. The reference to uniform deposit means that the deposit is in the form of a frame or border arrangement of substantially constant width, which follows the periphery of the glass.

FIGS. 2 and 3 show a first illustrative embodiment of the glass with its printed circuit. FIG. 2, which is a view of the inside face of the glass, shows the tracks of the printed circuit, which are formed directly on the inside face 6*a* of the glass. Before describing the different tracks in greater detail, it is appropriate to make it clear that the tracks may advantageously be produced by providing a uniform conducting metal deposit on the rim portion or the periphery of the inside face 6*a* of the glass, and then effecting etching of that deposit by conventional processes so as to leave only the conductor tracks and the connecting members. It will be appreciated that the etching processes must be compatible with the nature of the glass material forming the watch glass 6.

FIG. 2 also shows in broken line the inward limit of the deposit 8 forming the masking means which is deposited on the outside face 6*b* of the glass. The deposit which forms the masking means may be made of any material which adheres to the glass of the watch glass and which is of sufficient opacity to mask the printed circuit. The material will be so selected as to produce a pleasant effect with the face of the watch and its mounting.

It will be appreciated that the precise configuration of the different conductor tracks is linked to the particular structure of the watch. The illustrative example described herein corresponds to a particular form of watch. The definition of the invention in no way depends on the specific form of the conductor tracks, it being sufficient to state that the conductor tracks must be formed on the edge of the glass so that they can be masked, the masking means leaving sufficient space at the center of the glass for the watch face and the hands of the watch to be clearly visible.

In the particular embodiment shown in FIG. 2, the printed circuit comprises a first track 10 which connects a battery contact 12 to one of the terminals 14*a* of a capacitor 14. A second track 16 connects the output terminal 14*b* of the capacitor 14 to an input of the integrated circuit 18 and to one of the terminals 42′ of the resonator 20. Another track, as indicated by reference 22, connects the battery terminal 12 to an input of the integrated circuit 18. The tracks 24 and 26 respectively connect outputs of the integrated circuit 18 to the electrical contact members 28 and 30 corresponding for example to the negative pole of the battery and to the time resetting circuit. The tracks 32 and 34 respectively connect inputs/outputs of the integrated circuit 18 to the electrical contact members 36 and 38 for supplying the motor. Finally, the track 40 connects the integrated circuit 18 to the other terminal 42 of the resonator 20. It will be seen therefore that it is the glass 6 itself which serves as an insulating carrier for the printed circuit. It therefore replaces the conventional printed circuit insulating carriers.

It is important to note that the glass 6 also serves as a mechanical carrier for example for the capacitor 14 or for the resonator 20 which is fixed with respect to the glass by way of its terminals 42 and 42′ which are fixed on the metal platings and therefore on the glass. Likewise, the integrated circuit 18 is directly fixed or stuck to the inside face 6*a* of the glass.

It is also interesting to note that the electrical contact members such as 28, 30, 36 and 38 are extended by buffers or pads 44 or 46 of conducting rubber, which make it possible to form the electrical connection between the electrical contact members of the printed circuit and the terminals of the electrical or electronic components to be connected. Because the pads 44 or 46 are made of rubber, they apply a certain pressure to the electrical contacts of the components when the glass is set in position on the rim. They thus form an excellent electrical contact and make it possible to go into another conductor plane. Likewise, secured to the contact 12 which corresponds to the positive terminal of the battery is a battery clamp bar 50 comprising a resilient blade portion 50*a* which forms the contact to the corresponding electrode of the battery. In an alternative form, that contact may be formed by a flexible printed-circuit tongue portion comprising a conductor track, the other end of the tongue portion being screwed onto the battery or another conductor track which is located in the movement space of the watch. That makes it possible to ensure that the clamping pressure of the battery clamp bar on the battery is not applied to the glass, when the clamp bar is resilient.

In the first illustrative embodiment which has just been described hereinbefore, the printed circuit is formed on the inside face of the glass, while the metal plating which masks the printed circuit is provided on the outside face of the glass. However, in some cases it may be desirable to avoid metal plating on the outside face of the glass, for example in order to ensure that scratches do not occur in use.

FIG. 4 shows a diagrammatic view of an alternative embodiment. In this embodiment, a first uniform metal plating 8' is formed on the inside face 6*a* of the glass. The first metal plating serves as the masking means 8 of FIGS. 2 and 3. A deposit 9 of an insulating material such as silica is then produced, and entirely covers the first metal plating. Finally a second metal plating which is indicated by reference 9' and which will be used to form the printed circuit is deposited. The second metal plating 9' is etched by any suitable process for defining conductor tracks such as those shown in FIG. 2.

FIG. 5 shows a view in vertical section of an embodiment of a watch provided with the glass shown in FIGS. 2 and 3. The watch comprises a casing 2 which is formed by the rim casing member 50 and the bottom member 52. The glass 6 provided with its masking means 8 is fixed on the member 50 by means of the shoulder 54. A watch face 56, which is for example flat, is fixed on a second shoulder 58 of the member 50, by means of lugs such as indicated at 56*a* and 56*b*. As is well known, the spindles 60 and 60' for the hands 62 and 62' pass through the face 56 and are fixed with respect to wheels 64 and 64'. For example, the stepping motor 66 is fixed on the bottom member 52 of the casing 2. The electrical contacts 44 or 46 pass through the face 56 by way of the openings provided between the fixing lugs 56*a* or 56*b* of the face. The components such as the resonator 20 or the capacitor 14 are housed between the face 56 and the glass 6. They are hidden by the masking means 8. In addition, the bulkier components such as the battery may be at least partially housed between the glass 6 and the bottom 52 by placing them in line with the openings provided in the face 56. The glass could also have been of the type shown in FIG. 4.

It will be appreciated that the invention is in no way limited to the type of watch described with reference to FIG. 5. The glass provided with the conductor tracks may be fitted to all kinds of electronic watch. However, this embodiment of the glass is of optimum interest when the watch is of the very flat type.

In addition, the printed circuit may occupy only some edges of the glass 6, depending on the nature of the tracks to be produced. The masking means 8 must obviously cover the edges which are used to form the printed circuit. It may also cover one or more edges which are not used, for aesthetic reasons.

It will be seen therefore that the present invention makes it possible to eliminate the conventional printed circuit of the watch. In addition, because some components can be directly fixed on the glass, there is a saving of space in the watch casing, for housing the other components or gear trains. Finally, by virtue of the provision of the masking means, the aesthetic qualities of the watch are not detrimintally affected.

Various other modifications of the present invention will be apparent to those skilled in the art, and it therefore is intended that the scope of the present invention be limited solely by the scope of the appended claims.

What is claimed is:

1. An electronic watch comprising a casing, said casing having an electronic watch circuit positioned therewithin, the components of said circuit including at least a battery, a display system, a resonator and an integrated circuit, said casing having a glass mounted thereon, said glass having an outside face and an inside face, with the peripheral edge of said inside face serving as a mechanical support for at least one of said components, and a plurality of electrically conductive tracks formed on at least said peripheral edge for making electrical connections between said components.

2. A watch according to claim 1 further comprising on one of its faces a deposit serving to mask said electrically conductive tracks.

3. A watch according to claim 2 wherein said deposit is disposed on the outside face of the glass.

4. A watch according to claim 2 wherein said deposit is disposed on the inside face of the glass, said watch further comprising an insulating layer which is interposed between said deposit and said electrically conductive tracks.

5. A watch according to either one of claims 3 and 4 wherein said integrated circuit is also disposed on the inside face of the glass.

6. A watch according to either one of claims 3 and 4 and further comprising at least one resilient conductor pad member of which a first end is fixed to said inside face in line with the electrically conductive tracks, while the other end forms an electrical contact with one of the components of the watch.

7. A watch according to either one of claims 3 and 4 and further comprising a conducting clamp bar on which one end is fixed to said inside face in line with the electrically conductive tracks, while the other end provides an electrical contact with a component of the watch.

* * * * *